US010213631B2

(12) United States Patent
McKay

(10) Patent No.: US 10,213,631 B2
(45) Date of Patent: Feb. 26, 2019

(54) LINEMAN HARNESS ADAPTER SYSTEM

(71) Applicant: Nelson O. McKay, Santa Ana, CA (US)

(72) Inventor: Nelson O. McKay, Santa Ana, CA (US)

( * ) Notice: Subject to any disclaimer, the term of this patent is extended or adjusted under 35 U.S.C. 154(b) by 0 days.

(21) Appl. No.: 15/247,071

(22) Filed: Aug. 25, 2016

(65) Prior Publication Data

US 2016/0375279 A1 Dec. 29, 2016

(51) Int. Cl.
*A62B 35/00* (2006.01)

(52) U.S. Cl.
CPC ..... *A62B 35/0075* (2013.01); *A62B 35/0018* (2013.01)

(58) Field of Classification Search
CPC ..... A62B 35/0075; A62B 35/0018
See application file for complete search history.

(56) References Cited

U.S. PATENT DOCUMENTS 3,701,395 A * 10/1972 Theobald ..... A62B 35/0018 128/845
9,308,402 B2 * 4/2016 Chevalier ..... A62B 35/00
2008/0011545 A1 * 1/2008 Turner ..... A62B 1/16 182/6
2009/0255756 A1 * 10/2009 Green ..... A62B 35/0012 182/3
2012/0012421 A1 * 1/2012 Morgan ..... A62B 35/0012 182/3
2013/0062144 A1 * 3/2013 Fleming ..... B60R 22/02 182/3
2016/0176683 A1 * 6/2016 Huehn ..... B66C 1/16 294/74

OTHER PUBLICATIONS

Ver Sales Inc., catalog 106, p. 115; Burbank, CA.., USA.

* cited by examiner

*Primary Examiner* — Alvin C Chin-Shue
(74) *Attorney, Agent, or Firm* — Cionca IP Law P.C.; Marin Cionca

(57) ABSTRACT

A lineman safety harness adapter system for use in association with a harness, having: a first harness adapter having a first strap having a first top end and a first bottom end loop configured to receive a first locking element at a first bottom end, a second strap having a second top end and a second bottom end loop configured to receive a second locking element at a second bottom end, a third strap having a third top end and a third bottom end loop configured to receive a third locking element at a third bottom end; the first strap, the second strap, and the third strap meeting at the first top end, the second top end, and the third top end into a first top loop configured to receive a fourth locking element.

13 Claims, 7 Drawing Sheets

LINEMAN HARNESS ADAPTER SYSTEM

CROSS-REFERENCE TO RELATED APPLICATIONS

Not applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF INVENTION

1. Field of the Invention

The invention relates generally to safety equipment and more specifically to harnesses for preventing falls and/or for securing to a safety line.

2. Description of the Related Art

Linemen working to repair telephone lines, perform rescue operations, and other similar functions may be transported and supported by helicopter, and may wear harnesses for fall protection during such repair or rescue work. Harnesses known in the art can be unsafe since some inhibit blood flow in the legs. Front-attached harnesses, with a safety cable attaching to the lineman's chest, for example, can run in front of their body and restrict the vision and/or movement of the lineman, who then may have to lean to the side to perform their work. Back-attached harnesses may use leg loops, which, when supported only by a single point on the user's back, may tighten and restrict blood flow in the legs. Therefore, a solution is needed to safely support a lineman from the back.

When connecting two or more linemen together, the connecting safety rope between individuals may be in the front of the lower person. Therefore, this individual's vision may be restricted, and a solution is needed to safely support two more linemen together by connecting them via back-attached harnesses.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

In an aspect an adapter for a full body harness is provided, for vertical use during rescue, repair, or other work performed by a lineman, wherein the adapter straps are placed on the user's back and has three points of attachment to the full body harness. Thus, an advantage is the weight of the user is more evenly distributed throughout the full body harness. Another advantage is that there is no visual obstruction or restriction of movement for the user, with the adapter and safety line being placed behind the user.

In another aspect, an adapter for a full body harness is provided, having an additional loop at the end of the adapter straps, for connecting a first user to a second user. Thus, an advantage is that a plurality of users may be safely connected without visual obstruction, without movement restriction, and with even weight distribution throughout their full body harnesses.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
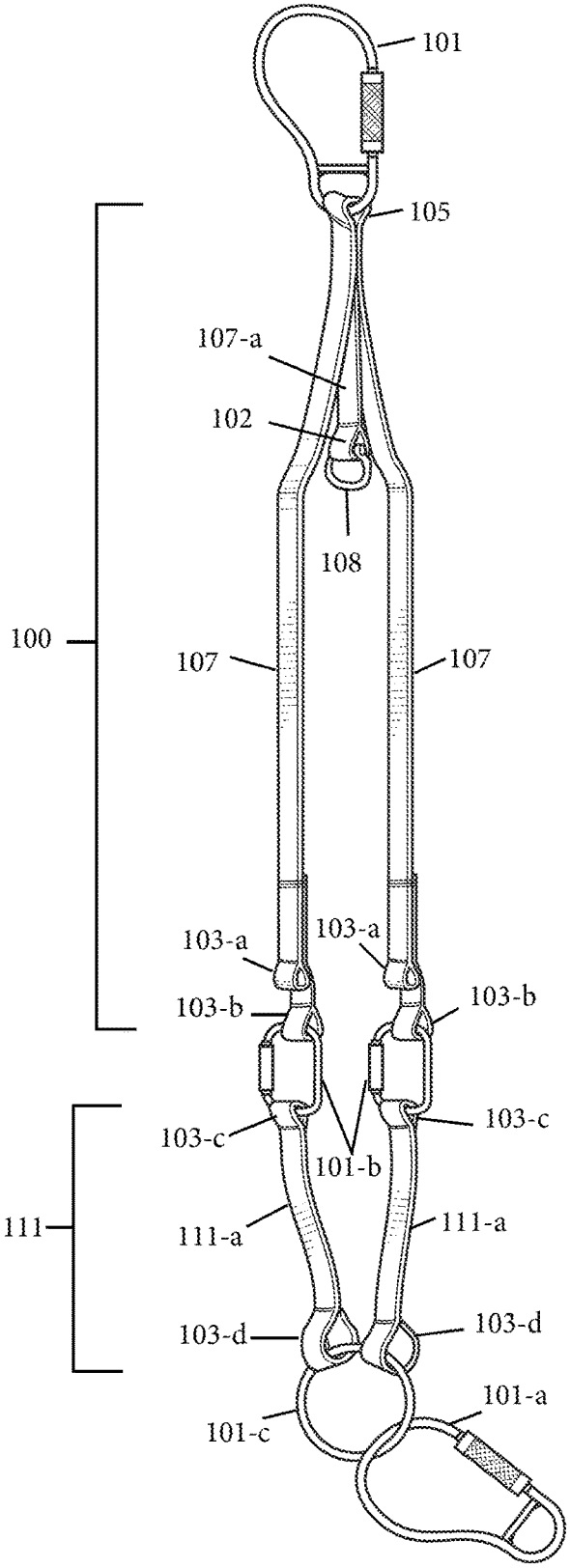
FIG. 1 illustrates the front perspective view of a three-point lineman harness adapter system, according to an aspect.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention. Therefore, the scope of the invention is defined by the accompanying claims and their equivalents.

For the following description, it can be assumed that most correspondingly labeled elements across the figures (e.g., 104 and 204, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

Figure 2:
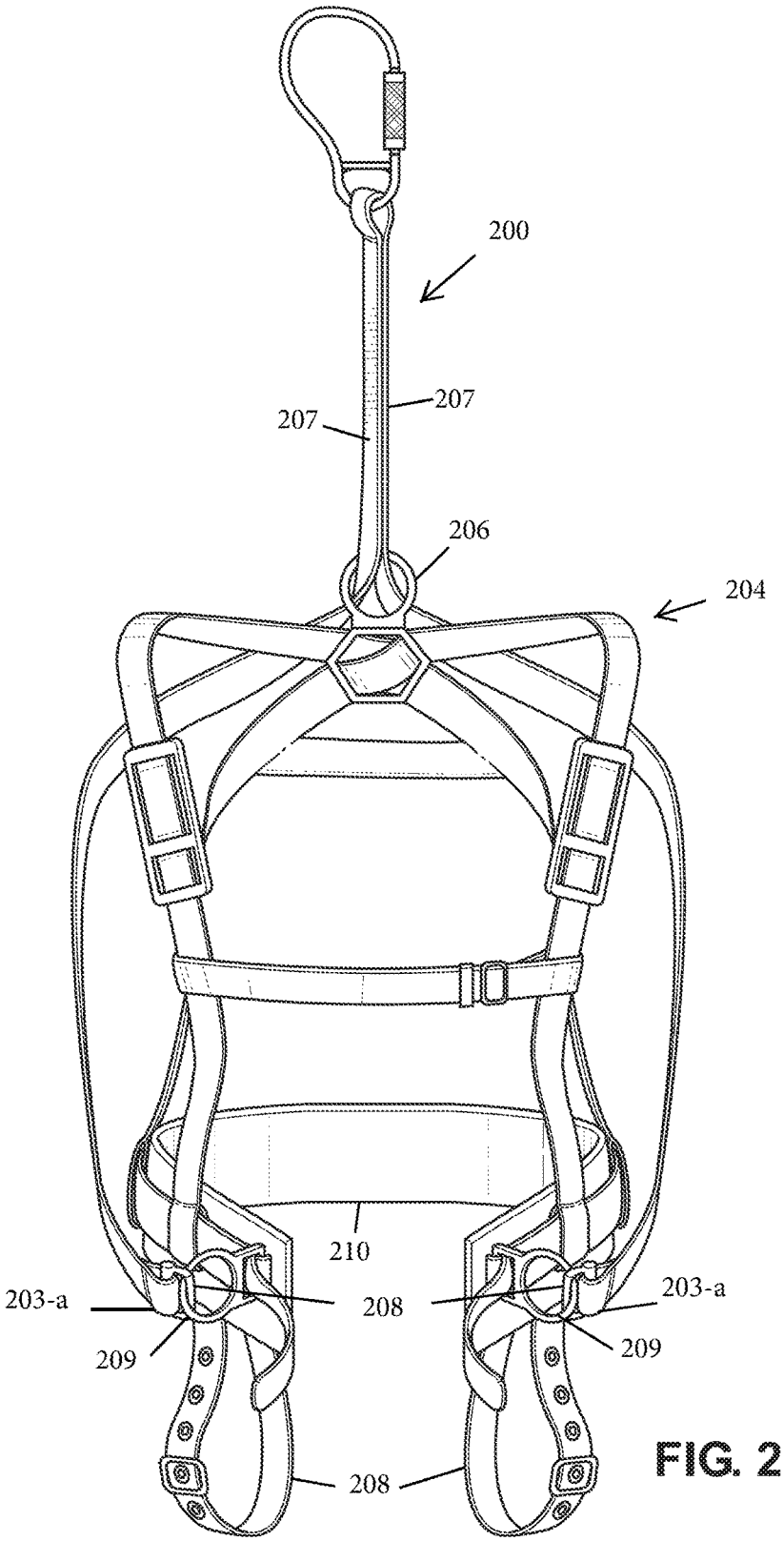
FIG. 2 illustrates the front view of the harness adapter used in association with a full body harness, according to an aspect.

FIG. 1 illustrates the front perspective view of a three-point lineman harness adapter 100 ("three-point harness adapter," "lineman harness adapter," or "harness adapter") system, according to an aspect. The harness adapter 100 of the system may be used in conjunction with, for example, a full body harness ("full body harness," "body harness," or "harness"), as shown by 204 in FIG. 2, or any combination of a chest harness and/or seat harness, and may also be used in association with additional harness adapters by using a harness adapter connector 111. The harness adapter 100 may be securely connected to another element, such as, for example, a helicopter, another user, or a safety line, by a carabiner 101 or any other suitable locking element that hooks into a top loop 105 of the harness adapter 100. The helicopter, other user, or any other secure element that the carabiner 101 or other locking element may be suspended above the user that is wearing the lineman harness adapter 100 and associated harness. The harness adapter 100 may have two straps 107, each of which may include a first bottom loop ("bottom loop" or "bottom end loop") 103-*a* and a second bottom loop 103-*b* at their ends as shown ("end loop pair"), or may include only one bottom loop 103-*a* at each end (as shown in FIG. 2). An end loop pair may include one harness loop 103-*a* and one extension loop 103-*b*. The harness loops 103-*a* may be used to connect the harness adapter 100 to a body harness, and the extension loops 103-*b* may be used to connect a user wearing the harness adapter system to another user wearing a harness adapter system.

The harness adapter 100 may also include a third strap 107-*a*, which may be shorter than the first and second straps 107. The first and second straps 107 and third strap 107-*a* may converge at their top ends to form a top loop 105. A harness adapter 100 having one or two bottom loops may be used according to the user's needs. The three points of attachment to a harness worn by a user may be using the back loop 102, which may have a D-ring 108 or any other suitable locking element to lock the back loop into the full body harness 304 (as shown in FIG. 3), and bottom loops 103-*a* and/or 103-*b*, which may lock into a belt portion of the full body harness (as shown by 210 in FIG. 2).

Figure 7:
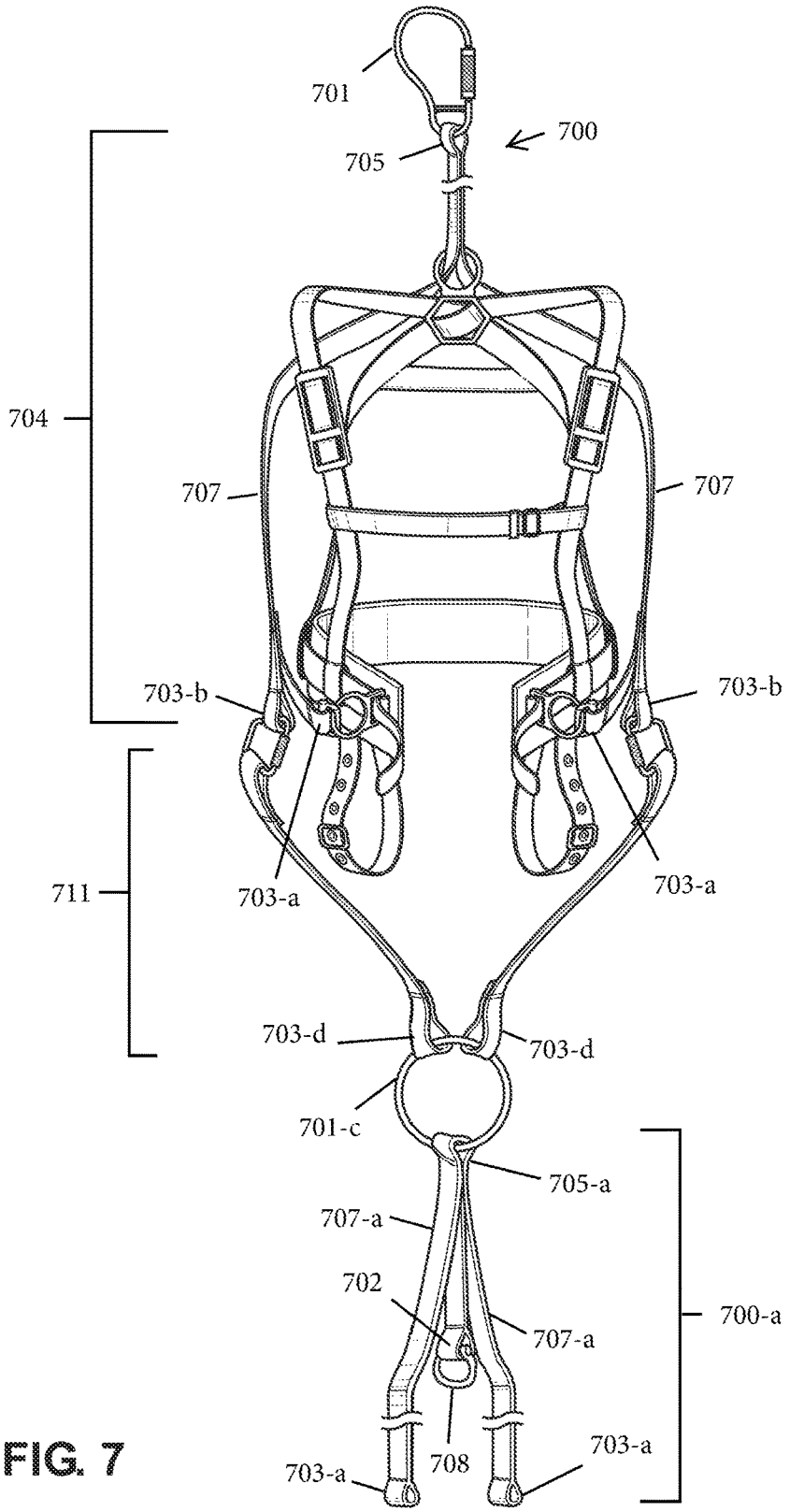
FIG. 7 illustrates a front view of a harness adapter system having a first harness adapter, a first full body harness, and a second harness adapter, and a harness adapter connector, according to an aspect.

As an example, a harness adapter 100 having only one bottom loop 103-*a* may be used if only one user is to be connected to a safety line, while a harness adapter 100 having two bottom loops 103-*a* and 103-*b* may be used if a first user will be connected to a safety line, and a second user will also be connected to the first user. If, for example, a second user is to be connected to the first user, a harness adapter connector 111 may be used, which may comprise two straps 111-*a* each having a top connector end loop 103-*c* and a bottom connector end loop 103-*d*. An O-ring 101-*c* and a second carabiner 101-*a* or any other suitable locking element may be used to secure the second user's harness adapter to the first harness adapter 100 via the harness adapter connector 111, as shown in FIG. 1. The O-ring 101-*c* may be secured in the bottom connector end loops 103-*d* of the harness adapter connector 111. The O-ring 101-*c* may then connect to a second carabiner 101-*a*, or may directly connect with a second user's harness adapter (as shown in FIG. 7).

FIG. 2 illustrates the front view of the harness adapter 200 used in association with a full body harness 204, according to an aspect. The harness adapter 200 may be used with a full body harness, a prior art example of a full body harness being shown by 204. The harness adapter 200 may connect with the full body harness 204 at three attachment points. First, the two straps 207 may pass through a back ring 206 of the full body harness 204, to which the top loop is secured. The top loop (shown as 105 in FIG. 1) may connect to the back ring 206 (not shown in FIG. 2, shown in FIG. 3). Second, one strap 207 may connect to the full body harness 204 on the left side of the user. Third, the other strap 207 may connect to the full body harness 204 on the right side of the user, similar to the connection on the left side. Belt rings 209 may be attached to a full body harness 204 or a seat harness on a belt portion 210, and may be used for making the second and third connections to the harness adapter 200. The three points of attachment may help to relieve pressure from the leg loops 208 by more evenly distributing the weight of the user held by the harness 204 and harness adapter 200.

Figure 3:
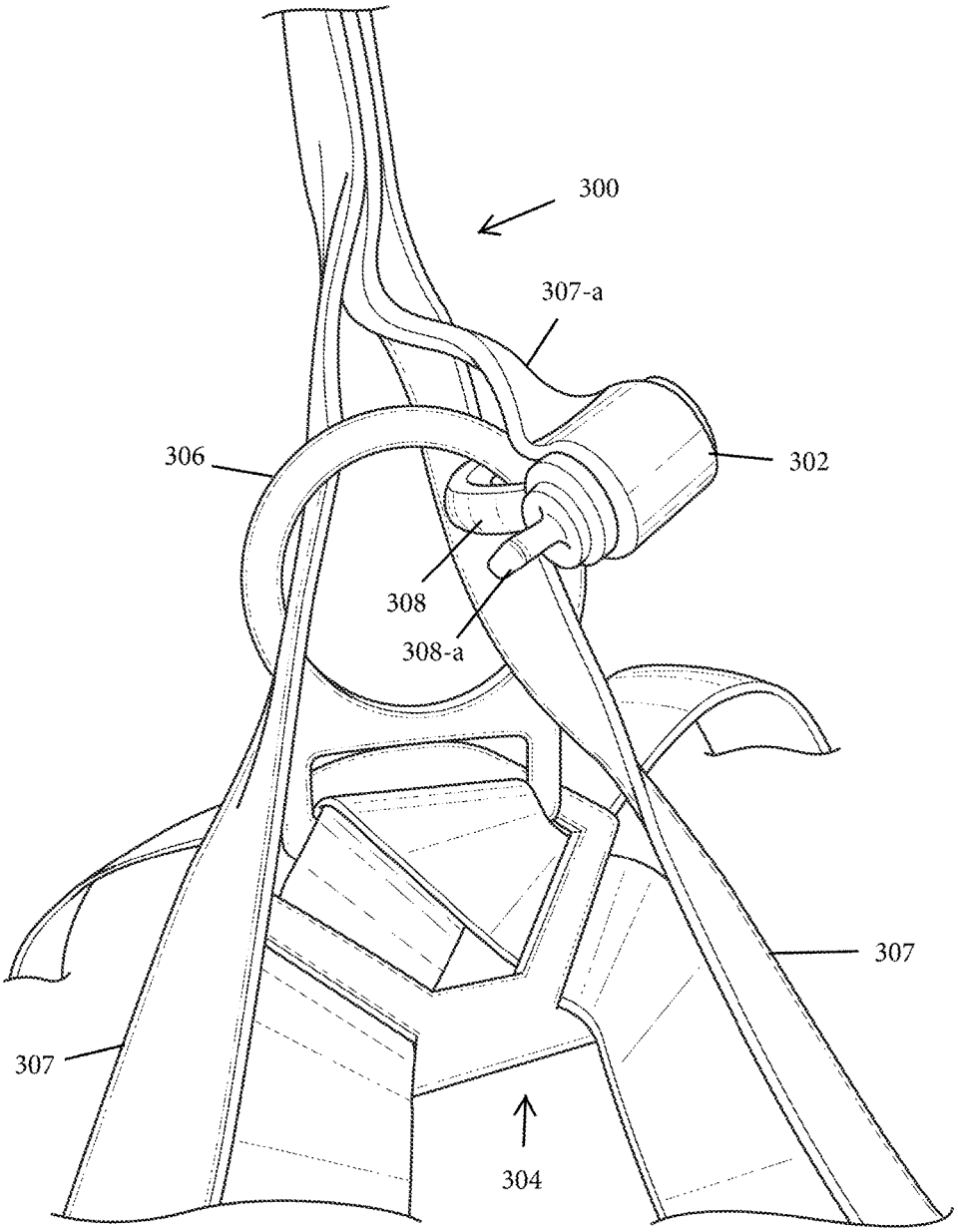
FIG. 3 illustrates a detailed enlargement of the back view of the back loop 302 of the harness adapter 300 connecting to the back ring 306 of the full body harness 304, according to an aspect.

FIG. 3 illustrates a detailed enlargement of the partial back view of the back loop 302 of the harness adapter 300 connecting to the back ring 306 of the full body harness 304, according to an aspect. The harness adapter 300 may include a first strap 307, a second strap 307 similar to the first strap, and a third strap 307-*a* shorter than the first and second straps 307. The third strap 307-*a* may include a back loop 302 at its bottom end. The first and second straps 307 may be inserted through the back ring 306, while the back loop 302 may be locked into the same back ring 306 by a D-ring 308 or any other suitable locking element. The D-ring or other type of locking element may be threaded into the back loop 302, and secured into place by, for example, a screw 308-*a*. The back ring 306 may be worn on the back of the user's torso when a harness is worn. As an example, the back ring 306 may be placed at or around the level of the user's shoulders, and may be placed between the shoulder blades of the user.

Figure 4:
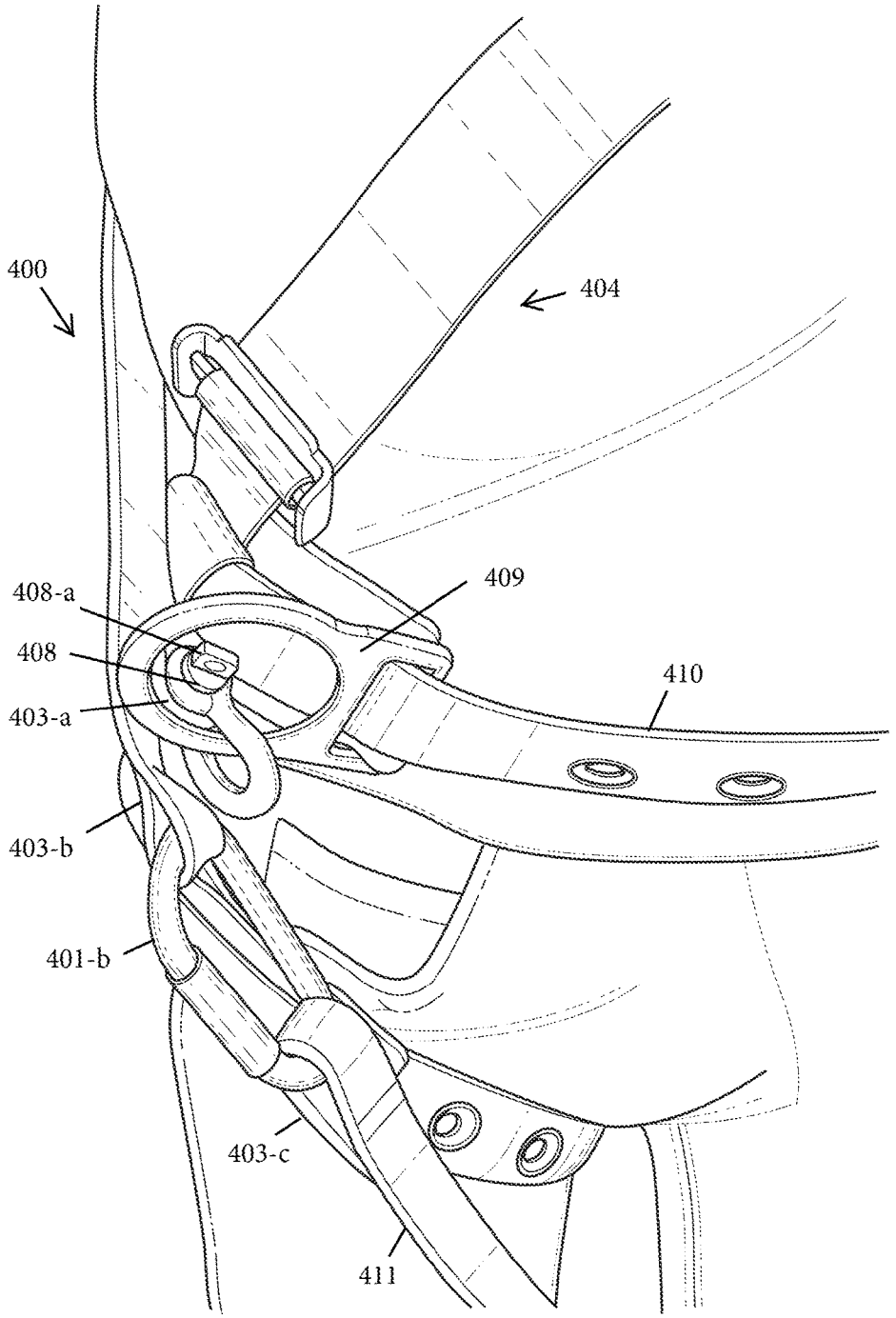
FIG. 4 illustrates a detailed enlargement of the front view of the harness adapter connected to a belt ring of the full body harness belt, according to an aspect.

FIG. 4 illustrates a detailed enlargement of the partial front view of the harness adapter 400 connected to a belt ring 409 of the full body harness belt 410, according to an aspect. Similar to the connection of the D-ring 308 in the back loop 302 to the back ring 306 (as shown in FIG. 3), one bottom loop 403-*a* may be connected to a belt ring 409, by a D-ring 408 or any other suitable locking element threaded into the bottom loop 403-*a* and secured by, for example, a screw 408-*a*. As an example, a front view of the user's right side is shown in FIG. 4. A similar connection may be made also on the user's left side. The two belt rings 409 may be located on a belt portion 410 of the full body harness 404, with one belt ring 409 located at the left side at the waist level of the user, and the second belt ring 409 located at the right side at the waist level of the user.

If, for example, a second user is to be connected to the first user, a carabiner 101-*b* may be inserted into the second bottom loop 403-*b* and the top connector end loop 403-*c* of the harness adapter connector 411.

Figure 5:
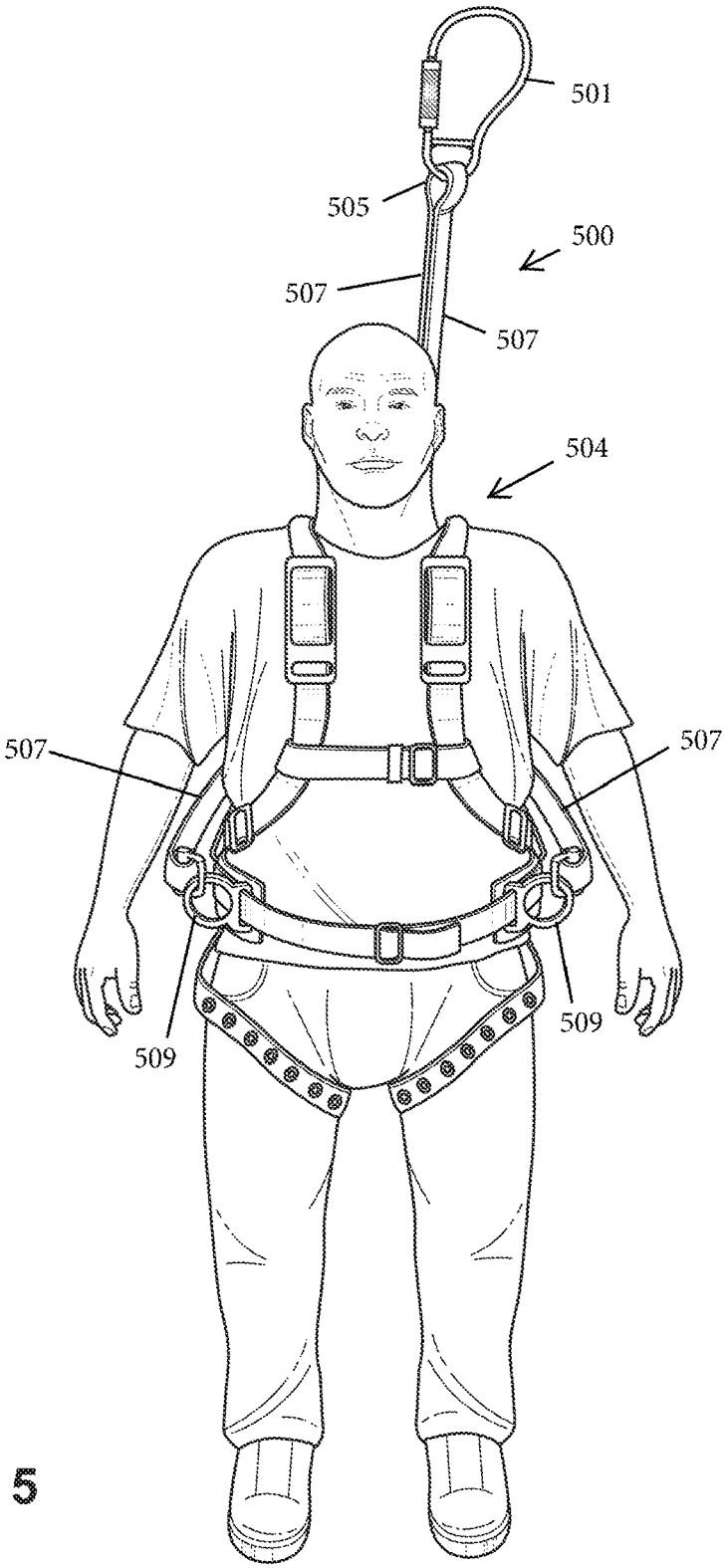
FIG. 5 illustrates the front view of the harness adapter connected with a full body harness, worn by a user, according to an aspect.

FIG. 5 illustrates the front view of the harness adapter 500 connected with a full body harness 504, worn by a user, according to an aspect. The straps 507 of the harness adapter 500 may be positioned behind the user, such that the harness adapter 500 connecting the user to, for example, a helicopter, by a carabiner 501 threaded into top loop 505, does not need to be attached in front of the user. The straps 507 may then come to the sides of the user, and connect to the harness 504. Two points of attachment may be at the sides of the waist of the user, as shown by belt rings 509.

Figure 6:
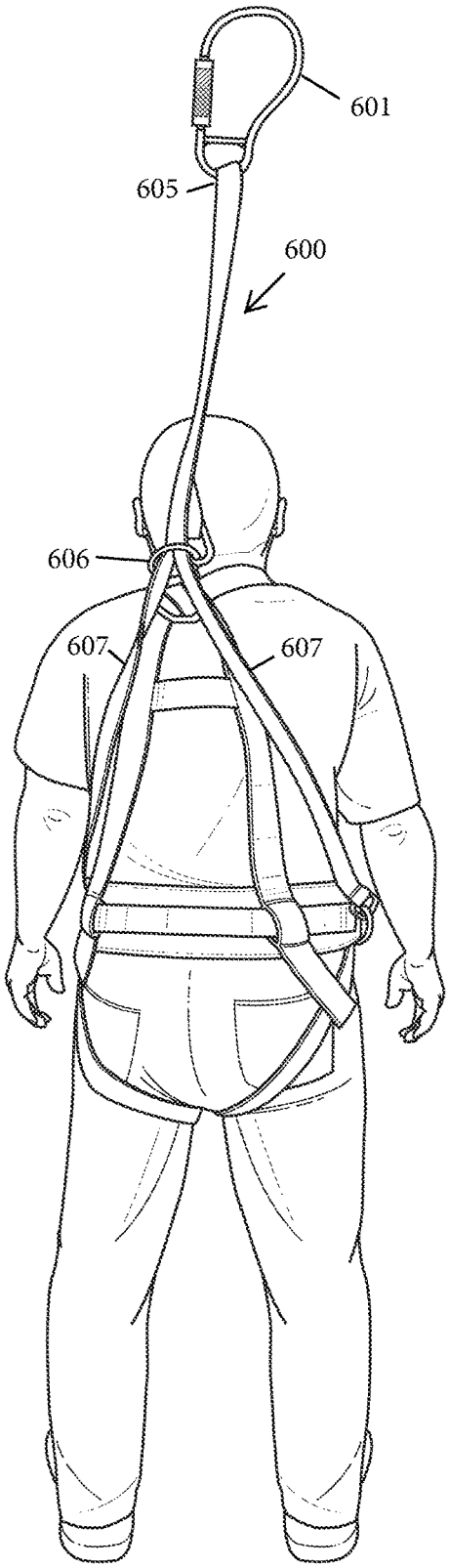
FIG. 6 illustrates the back view of the harness adapter connected with a full body harness, worn by a user, according to an aspect.

FIG. 6 illustrates the back view of the harness adapter 600 connected with a full body harness 604, worn by a user, according to an aspect. The straps 607 of the harness adapter

600 may both thread through a back ring 606. The back ring 606 may be located at the back of a user's torso, as shown. When a harness adapter 600 is connected to an object or person above the user, by a carabiner or any other suitable locking element threading through top loop 605, the user may be held vertically without any straps or connections in front of them. A connection to a helicopter or to another user by an attachment point on, for example, the user's chest may obstruct the user's vision and/or accessibility to their work. Thus, an advantage of the harness adapter 500 having an attachment point on the user's back is that the user is free of obstructions.

FIG. 7 illustrates a front view of a harness adapter system having a first harness adapter 700, a first full body harness 704, and a second harness adapter 700-*a*, and a harness adapter connector 711, according to an aspect. The first harness adapter 700 may be connected with a first full body harness 704 to be worn by a first user (as shown in FIG. 5). The first full body harness 704 may also be connected to a second harness adapter 700-*a* via a harness adapter connector 711. The second harness adapter 700-*a* may include one bottom loop 703-*a* at the end of each strap 707-*a* as shown, or, if a third user is to be connected, may include two bottom loops, similar to the loops 703-*a* and 703-*b* of the end loop pairs at the ends of the straps 707 of the first harness adapter 700. As an example, a plurality of harness adapters may be connected in a line, with a harness adapter connector in between the harness adapters. A second harness adapter 700-*a* may preferably be connected to the harness adapter connector 711 by securing a carabiner, similar to 701, to an O-ring 701-*c* that is threaded into the bottom connector end loops 703-*d*. As another example, the O-ring 701-*c* or any other suitable locking or connecting element may be used to secure the bottom connector end loops 703-*d* of the harness adapter connector 711 to a top loop 705-*a* of a second harness adapter 700-*a*, as shown. The second harness adapter 700-*a* may then be used in association with a second harness worn by a second user. The second harness adapter 700-*a* may also include a back loop 702 having a D-ring 708, or any other suitable locking element, which may be used to lock the harness adapter 700-*a* into a full body harness. The uppermost harness adapter 100 in a chain may be secured to any secure element such as, for example, a helicopter, using the top loop 705 receiving a carabiner 701 or any other locking element, which may then be locked into the secure element.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A lineman safety harness adapter system, the system comprising a first harness adapter, and a harness having a belt, a back ring associated with the belt, a left ring connected to a left side of the belt, and a right ring connected to a right side of the belt, the first harness adapter having a first strap having a first top end, a first bottom end, and a first harness loop at the first bottom end, the first harness loop being configured to receive a first locking element, a second strap having a second top end, a second bottom end, and a second harness loop at the second bottom end, the second harness loop being configured to receive a second locking element, a third strap having a third top end, a third bottom end, and a back loop at the third bottom end, the back loop being configured to receive a third locking element; wherein the first strap, the second strap, and the third strap join at the first top end, the second top end, and the third top end into a single first top loop configured to receive a fourth locking element, wherein the first strap extends through the back ring and the first harness loop connects to the left ring; wherein the second strap extends through the back ring and the second harness loop connects to the right ring; and wherein the back loop is attached to the back ring.

2. The lineman safety harness adapter system of claim 1, further comprising a first extension loop configured to receive a fifth locking element at the first bottom end; and a second extension loop configured to receive a sixth locking element at the second bottom end.

3. The lineman safety harness adapter system of claim 2, further comprising a harness adapter connector having a first connector strap having a first top connector loop configured to receive the fifth locking element, and a second connector strap having a second top connector loop configured to receive the sixth locking element at a second top connector end; the first connector strap further comprising a first bottom connector loop at a first bottom connector end, and the second connector strap further comprising a second bottom connector loop at a second bottom connector end, the first bottom connector loop and the second bottom connector loop configured to receive a seventh locking element.

4. The lineman safety harness adapter system of claim 1, wherein the fourth locking element is a carabiner.

5. The lineman safety harness adapter system of claim 1, wherein the first locking element and the second locking element are a first D-ring and a second D-ring.

6. The lineman safety harness adapter system of claim 5, wherein the first and second D-rings are locked into place by a first screw and a second screw.

7. The lineman safety harness adapter system of claim 3, further comprising a second harness adapter, having a second top loop configured to receive the seventh locking element.

8. The lineman safety harness adapter system of claim 7, wherein the seventh locking element is an O-ring.

9. A lineman safety harness adapter system, the system comprising a first harness adapter, a harness adapter connector, and a harness having a belt, a back ring associated with the belt, a left ring connected to a left side of the belt, and a right ring connected to a right side of the belt, the first harness adapter having a first strap having a first top end, a first bottom end, a first harness loop at the first bottom end, and a first extension loop at the first bottom end, the first harness loop being configured to receive a first locking element; a second strap having a second top end, a second bottom end, a second harness loop at the second bottom end, and a second extension loop at the second bottom end, the second harness loop being configured to receive a second locking element; a third strap having a third top end, a third bottom end, a back loop at the third bottom end, the back loop being configured to receive a third locking element; wherein the first strap and the second strap each have a first length, and the third strap has a second length shorter than the first length; wherein the first strap, the second strap, and the third strap join at the first top end, the second top end, and the third top end into a single first top loop; wherein the first strap extends through the back ring and the first harness loop connects to the left ring; wherein the second strap extends through the back ring and the second harness loop connects to the right ring; wherein the back loop is attached to the back ring, the harness adapter connector comprising a first connector strap having a first top connector end, a first bottom connector end, a first top connector loop at the first top connector end, and a first bottom connector loop at the first bottom connector end;

and a second connector strap having a second top connector end, a second bottom connector end, a second top connector loop at the second top connector end, and a second bottom connector loop at the second bottom connector end; wherein the first top loop is configured to receive a fourth locking element; the first extension loop is joined to the first top connector loop by a fifth locking element; and the second extension loop is joined to the second top connector loop by a sixth locking element.

10. The lineman safety harness adapter system of claim 9, wherein the first bottom connector loop and the second bottom connector loop are configured to receive a seventh locking element.

11. The lineman safety harness adapter system of claim 9, wherein the first locking element and the second locking element are a first D-ring and a second D-ring.

12. The lineman safety harness adapter system of claim 11, wherein the first and second D-rings are locked into place by a first screw and a second screw.

13. The lineman safety harness adapter system of claim 10, further comprising a second harness adapter, having a second top loop configured to receive the seventh locking element.

* * * * *